US012698608B2

(12) United States Patent
Elmore et al.

(10) Patent No.: US 12,698,608 B2
(45) Date of Patent: Aug. 4, 2026

(54) ROADWAY CRASH CUSHION

(71) Applicant: Lindsay Transportation Solutions, LLC, Omaha, NE (US)

(72) Inventors: Matthew A. Elmore, Rio Vista, CA (US); Jason T. Lim, Stockton, CA (US); Daniel Paul Dacayanan Loya, Elk Grove, CA (US); John James Angus, Omaha, NE (US)

(73) Assignee: Lindsay Transportation Solutions, LLC, Omaha, NE (US)

( * ) Notice: Subject to any disclaimer, the term of this patent is extended or adjusted under 35 U.S.C. 154(b) by 381 days.

(21) Appl. No.: 18/534,873

(22) Filed: Dec. 11, 2023

(65) Prior Publication Data

US 2025/0188692 A1 Jun. 12, 2025

(51) Int. Cl.
*E01F 15/14* (2006.01)

(52) U.S. Cl.
CPC ..... *E01F 15/146* (2013.01)

(58) Field of Classification Search
CPC ..... E01F 15/14; E01F 15/143; E01F 15/146; E01F 15/148
USPC ..... 256/13.1
See application file for complete search history.

(56) References Cited

U.S. PATENT DOCUMENTS 3,881,697 A * 5/1975 Glaesener ..... E01F 15/146 256/13.1
4,815,565 A * 3/1989 Sicking ..... E01F 15/146 404/6
5,348,416 A 9/1994 Ivey et al.
6,428,237 B1 * 8/2002 Duckett ..... E01F 15/146 404/6
12,421,678 B2 * 9/2025 Elmore ..... E01F 15/146
2005/0254893 A1 * 11/2005 Albritton ..... E01F 15/0423 404/6
2007/0134062 A1 * 6/2007 Alberson ..... E01F 15/146 404/6
2012/0257925 A1 * 10/2012 Rigomer ..... E01F 13/126 404/6
2024/0384483 A1 * 11/2024 Elmore ..... E01F 15/146
2025/0171969 A1 * 5/2025 Dacayanan Loya .. E01F 15/146

FOREIGN PATENT DOCUMENTS

KR 10-2021-0098671 A 8/2021
KR 10-2023-0007716 A 1/2023
WO WO-02086242 A1 * 10/2002 ..... E01F 15/143

OTHER PUBLICATIONS

International Search Report and Written Opinion in related PCT Application PCT/0S2024/058574 mailed Mar. 31, 2024, 12 pages.

* cited by examiner

*Primary Examiner* — Vishal R Sahni
(74) *Attorney, Agent, or Firm* — HOVEY WILLIAMS LLP

(57) ABSTRACT

A crash cushion that may be used as a traffic barrier end treatment is constructed to prevent an impacting vehicle from lifting off the ground and to minimize fragmentation and that is compatible with BTMs without compromise to impact mitigation performance. The crash cushion includes a nose assembly and a number of energy-absorbing modules connected to the nose assembly and to one another in an end-to-end fashion. The energy-absorbing elements are not all identical, but instead are constructed with different features and positioned or sequenced in particular ways to achieve specific performance objectives.

21 Claims, 6 Drawing Sheets

ROADWAY CRASH CUSHION

BACKGROUND

Traffic barrier systems are often placed on roadways to create barriers between opposing traffic lanes or between traffic lanes and roadside hazards and often include rigid barricades such as large concrete blocks to prevent lateral vehicle encroachment. Traffic barrier end treatments often precede leading barricades so that vehicles heading toward the leading barricades impact and are arrested by the traffic barrier end treatments instead.

Unfortunately, traffic barrier end treatments introduce other hazards to the occupants of impacting vehicles and nearby vehicles. For example, many traffic barrier end treatments launch impacting vehicles into the air or redirect them into adjacent lanes. The traffic barrier end treatments also buckle and burst into several fragments, which may damage nearby vehicles and harm their occupants.

Furthermore, some traffic barrier systems are moveable by barrier transfer machines (BTM) to create temporary barriers or to reconfigure the lanes. Many traffic barrier end treatments are not compatible with BTMs, while BTM-compatible traffic barrier end treatments have limited impact mitigation performance.

SUMMARY

Embodiments of the invention solve the above-mentioned problems and other problems and provide a distinct advance in the art of traffic barrier end treatments. More particularly, the invention provides an anchorless crash cushion, which may be used as a traffic barrier end treatment, and that is constructed to prevent an impacting vehicle from lifting off the ground and to minimize fragmentation. The crash cushion is also compatible with BTMs without compromise to impact mitigation performance.

The crash cushion apparatus broadly comprises a nose assembly and a number of energy-absorbing modules connected to the nose assembly and to one another in an end-to-end fashion. In accordance with an important aspect of the present invention, the energy-absorbing modules are not all identical, but instead are constructed with specific features and positioned and sequenced in particular ways to achieve desired performance objectives.

In one embodiment, the crash cushion includes the nose assembly; an energy-absorbing module of a first type attached to the nose assembly; and at least one energy-absorbing module of a second type directly or indirectly attached to the energy-absorbing module of the first type.

The nose assembly comprises, among other elements, a wedge incline. The energy absorbing module of the first type comprises a crash cushion element and a hinge plate assembly for supporting the crash cushion element. Importantly, the crash cushion element is not filled with water or other liquids and only encloses air or other gases. The hinge plate assembly includes an incline recess that receives the wedge incline of the nose assembly when the nose assembly is driven toward the energy-absorbing module by an impacting vehicle. The interaction between the wedge incline and the incline recess drives the energy-absorbing module upward as the crash cushion element is crushed and compacted. The hinge plate assembly also includes a wedge incline.

The energy absorbing module of the second type also comprises a crash cushion element and a hinge plate assembly for supporting the crash cushion element. Importantly, the crash cushion element of the second type is at least partially filled with water or other liquids. The hinge plate assembly includes an incline recess that receives the wedge incline of the energy absorbing module of the first type when the nose assembly is driven toward the energy-absorbing modules by an impacting vehicle. The interaction between the wedge incline and the incline recess drives the energy-absorbing module of the second type upward as the crash cushion elements are crushed and compacted. The hinge plate assembly also includes a wedge incline.

In another embodiment, the crash cushion further comprises at least one energy-absorbing module of a third type attached to the last energy-absorbing module of the second type. The energy absorbing module of the third type is essentially the same as the energy absorbing module of the second type except it has no wedge incline.

In yet another embodiment, the crash cushion further comprises at least one energy-absorbing module of a fourth type attached to the last energy-absorbing module of the third type. The energy absorbing module of the fourth type is essentially the same as the energy absorbing module of the third type except it has a crash cushion element with a larger volume.

In one specific embodiment, the crash cushion comprises the nose assembly, one energy-absorbing module of the first type; two energy-absorbing modules of the second type; three energy-absorbing modules of the third type; and three energy-absorbing modules of the fourth type. The crash cushion may also comprise a transition component attached to the last of the energy-absorbing modules of the fourth type for attaching the crash cushion to a traffic divider.

In use, the crash cushion arrests or otherwise slows a vehicle and stops the vehicle from reaching and impacting a traffic barrier to which the crash cushion is attached. When a vehicle impacts the nose assembly of the crash cushion, the nose assembly brackets the vehicle to prevent the vehicle from catapulting above the crash cushion. As the nose assembly is driven rearward, it successively crushes and compacts the crash cushion elements of the attached energy-absorbing modules. As the energy absorbing modules are compacted, the wedge incline of the nose assembly lifts the attached energy-absorbing module of the first type, the wedge incline of the energy-absorbing module of the first type lifts the adjacent energy-absorbing module of the second type, and the wedge incline of the energy-absorbing module of the second type lifts the adjacent energy-absorbing module of the third type. Upward movement of the energy-absorbing modules does not disconnect the energy-absorbing modules, but rather drives them into the subsequent energy-absorbing modules.

The crash cushion provides several advantages. For example, when impacted by a vehicle, the nose assembly elevates the first one of the energy-absorbing modules while the nose assembly remains in contact with the ground/road surface. Similarly, the wedge inclines of the energy-absorbing modules elevate subsequent energy-absorbing modules. This keeps the impacting vehicle from being catapulted or lifted off the ground/road surface. Moreover, by constructing the crash cushion with an unfilled crash cushion element adjacent the nose assembly, filled crash cushion elements after the unfilled one, and higher volume filled crash cushion elements next, an impacting vehicle is slowed and stopped more gradually to reduce the likelihood of injuring passengers in the vehicle.

The crash cushion is also compatible with a BTM. Specifically, the nose assembly and the energy-absorbing modules are pivotably connected via hinges and include structures for engaging rollers of the BTM.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
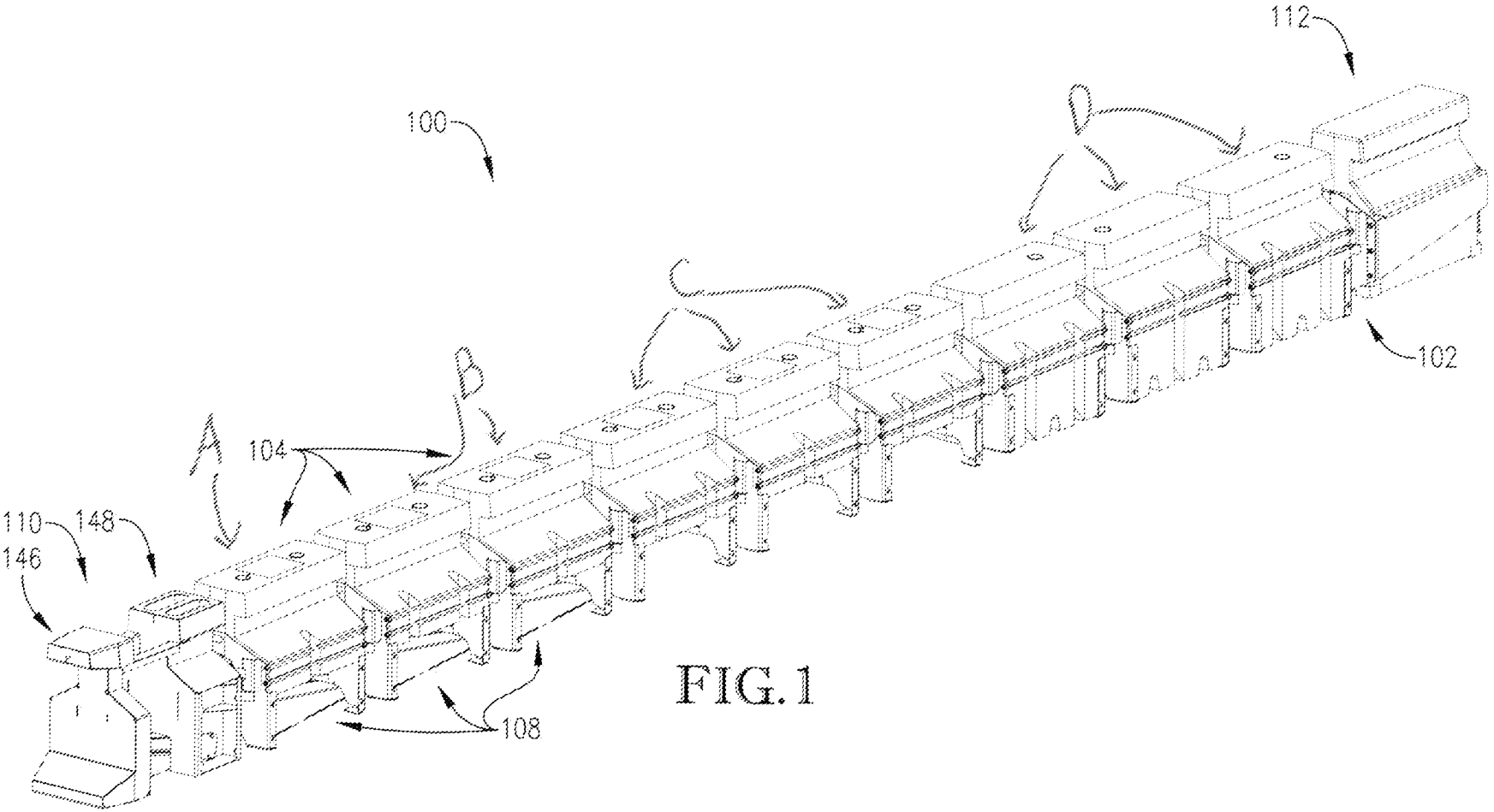
FIG. 1 is a perspective view of an anchorless crash cushion apparatus constructed in accordance with an embodiment of the invention.
Figure 2:
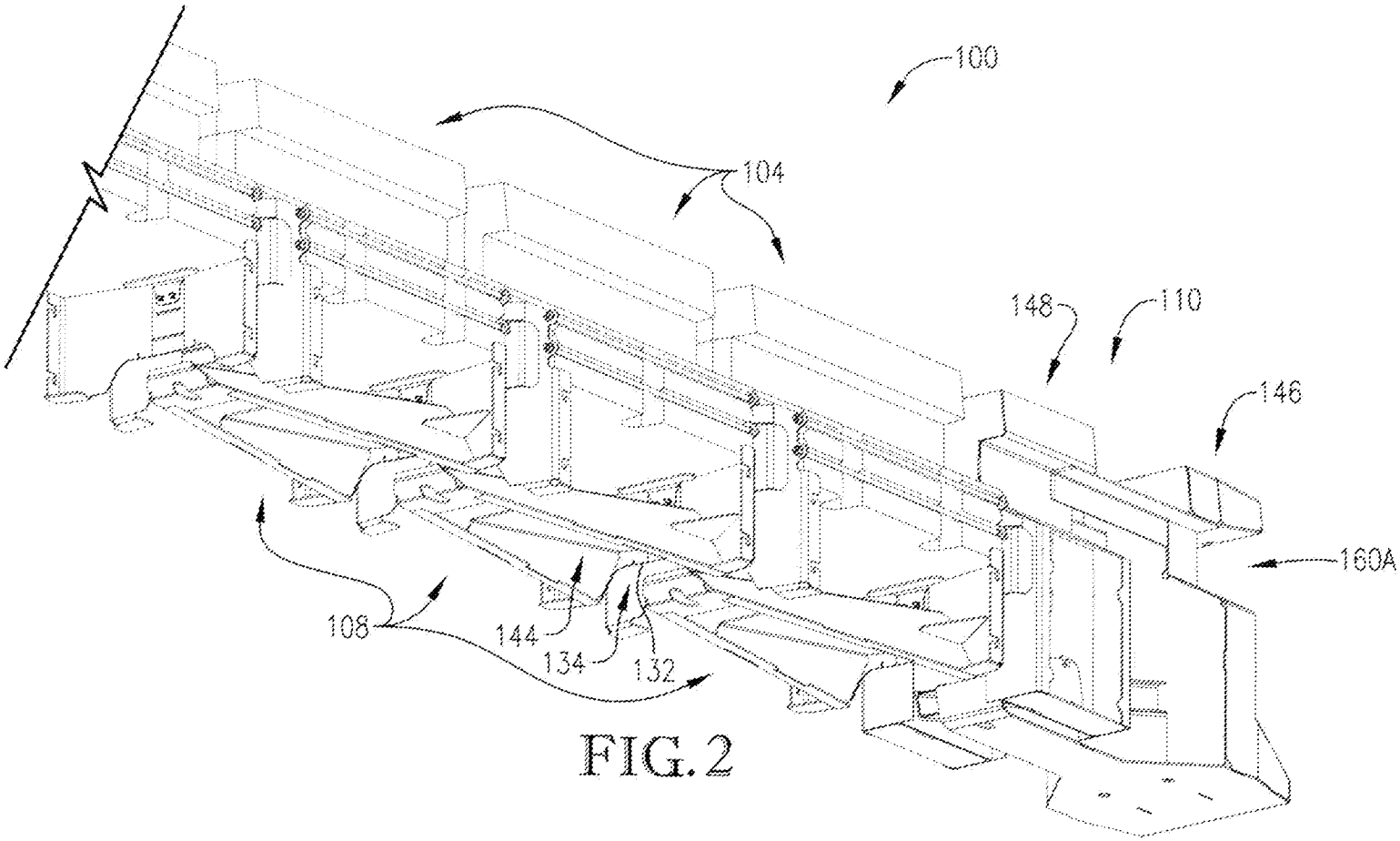
FIG. 2 is a bottom perspective view of the anchorless crash cushion apparatus of FIG. 1.
Figure 3A:
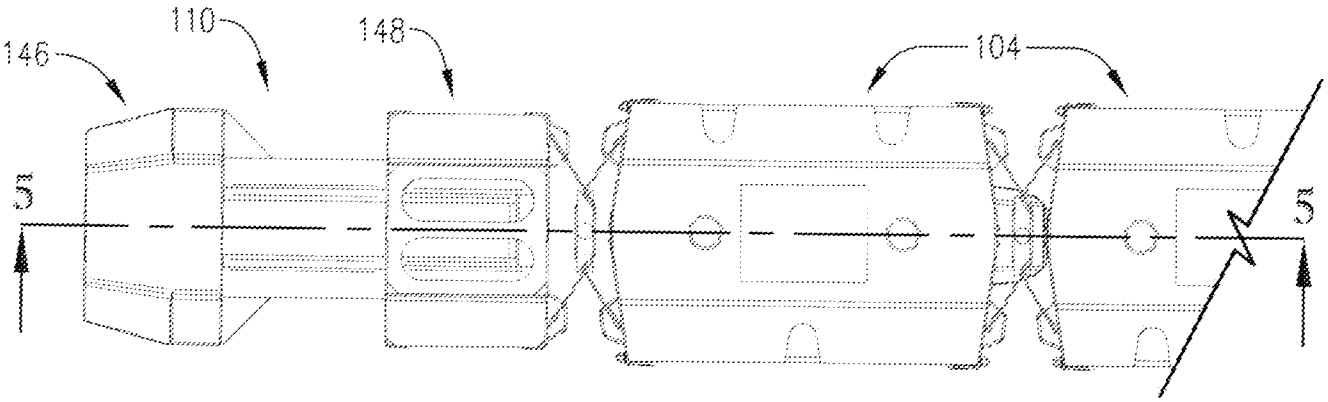
Figure 3B:
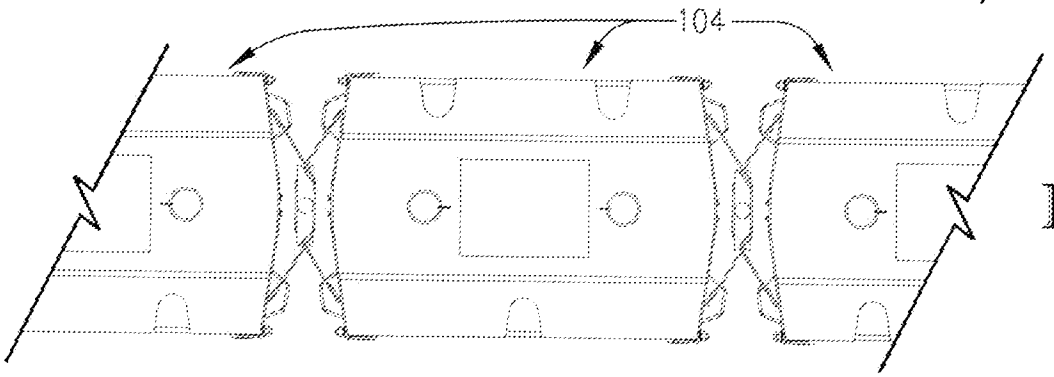
Figure 3C:
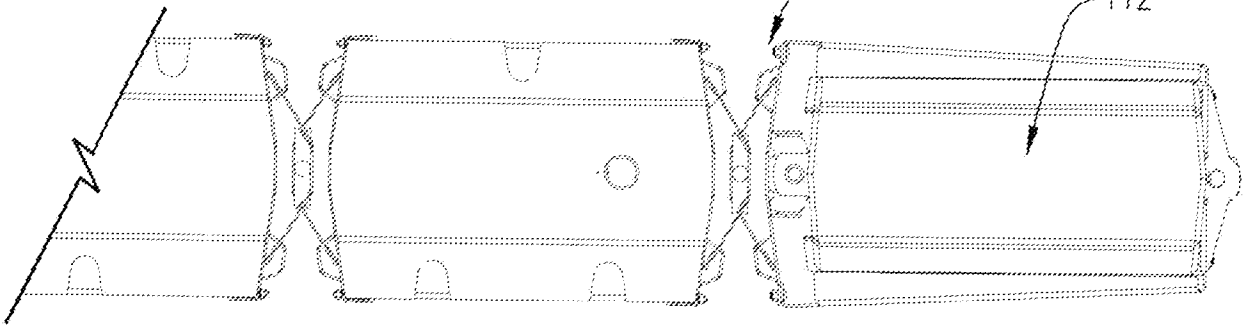
Figure 4:
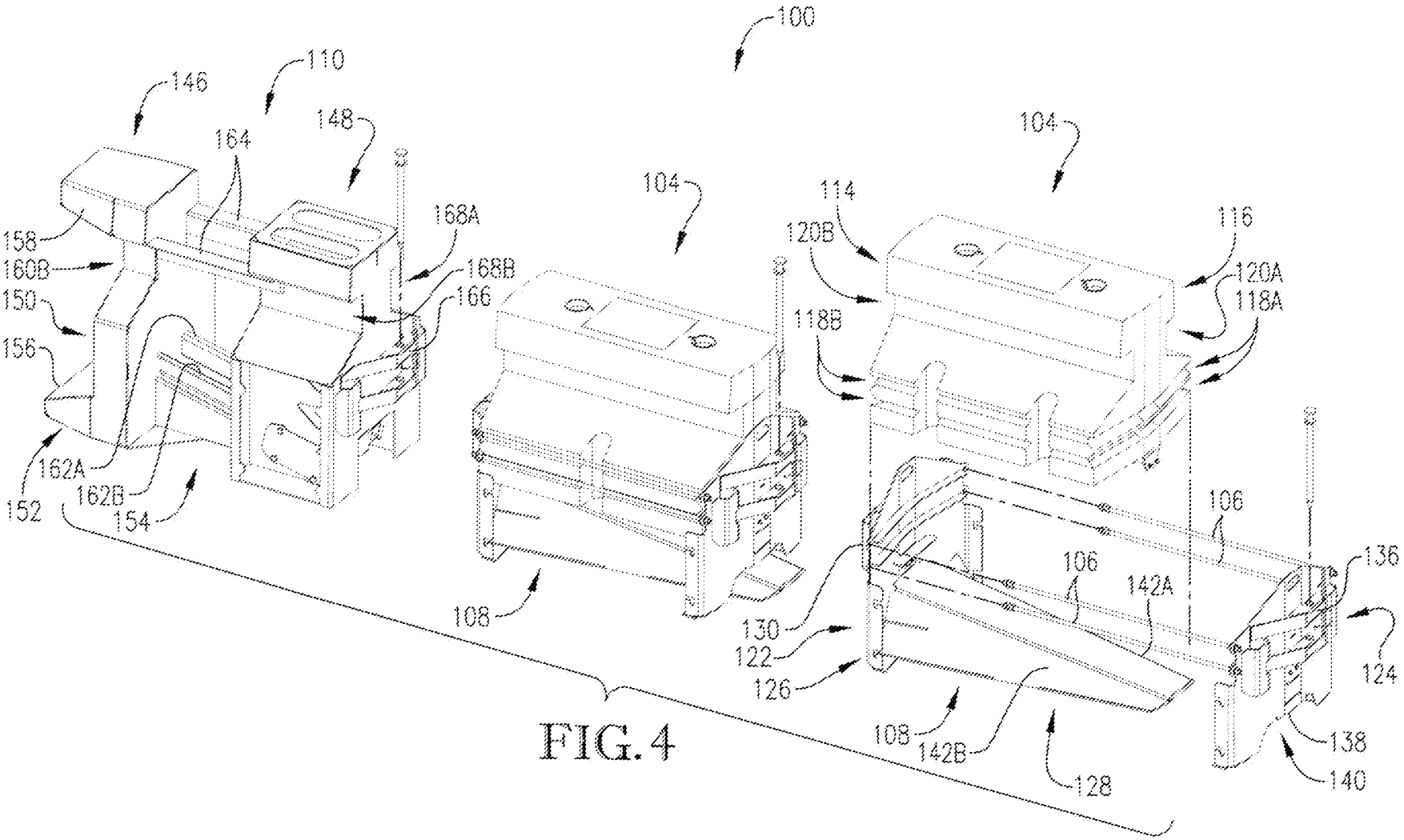
Figure 5:
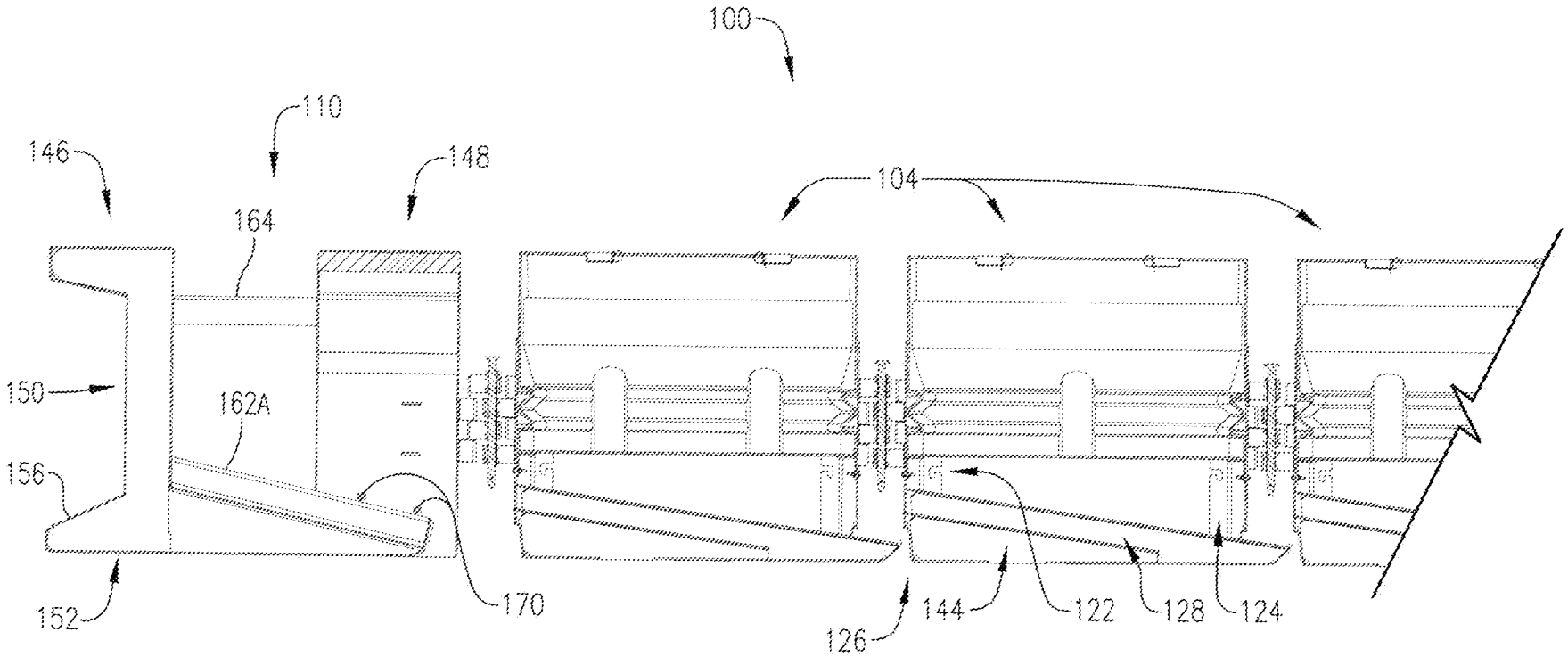
Figure 6:
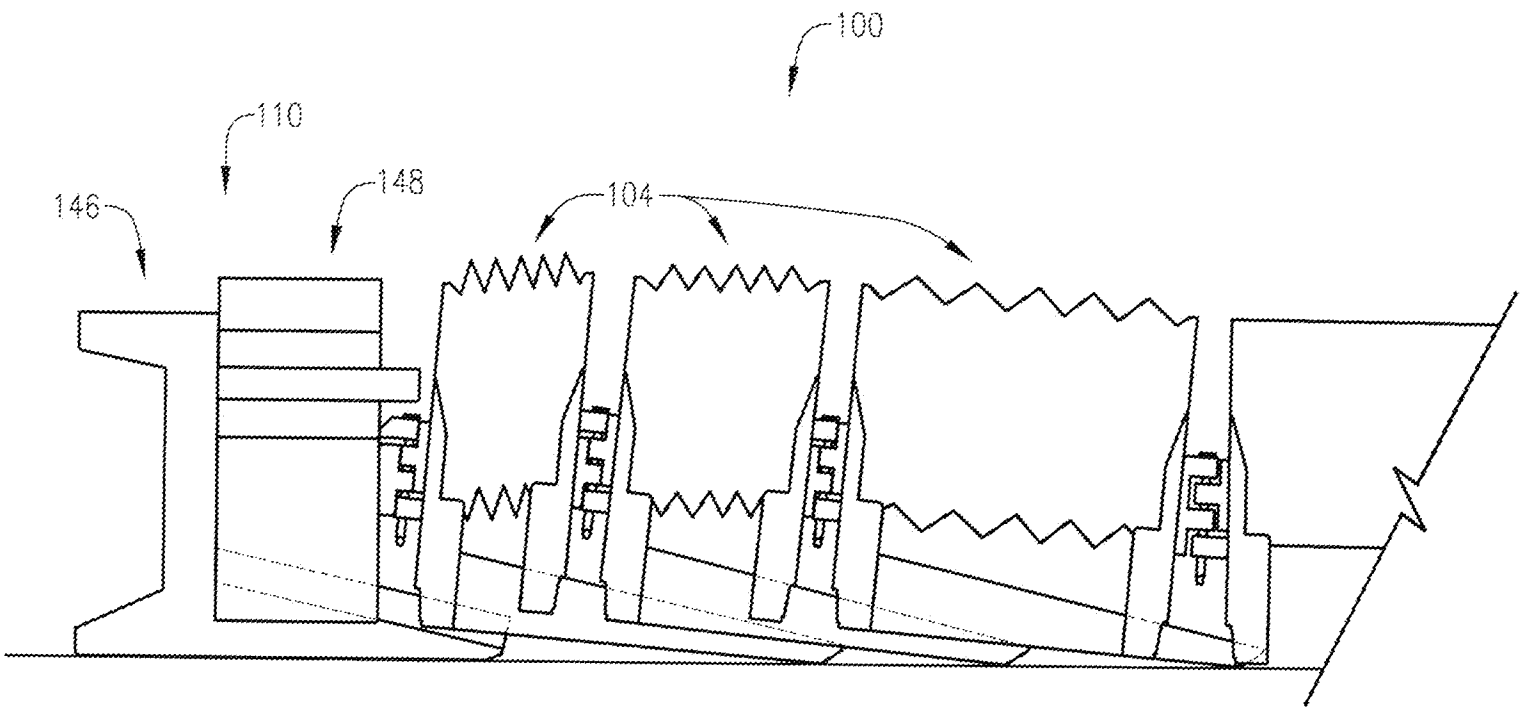

FIG. 3*a* is a plan view of a portion of the anchorless crash cushion apparatus of FIG. 1;

FIG. 3*b* is a plan view of another portion of the anchorless crash cushion apparatus of FIG. 1;

FIG. 3*c* is a plan view of another portion of the anchorless crash cushion apparatus of FIG. 1;

FIG. 4 is an exploded perspective view of certain components of the anchorless crash cushion apparatus of FIG. 1;

FIG. 5 is a cutaway elevation view of certain components of the anchorless crash cushion apparatus of FIG. 1; and FIG. 6 is a side elevation view of the anchorless crash cushion apparatus of FIG. 1 in an impacted state.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. As used in the specification and in the claims, ordering words such as "first" and "second" are used to distinguish between similar components and do not imply specific components. Thus, the current technology can include a variety of combinations and/or integrations of the embodiments described herein.

Turning to the drawing figures, an anchorless crash cushion apparatus 100 constructed in accordance with an embodiment of the invention is illustrated. The anchorless crash cushion apparatus 100 broadly comprises a transition component 102, a plurality of crash cushion elements 104, a plurality of stabilizing members 106, a plurality of hinge plate assemblies 108, and a nose assembly 110. As described below in connection with an important aspect of the invention, elements of the crash cushion 100 form a number of energy-absorbing modules A, B, C, D that are strategically constructed and sequenced to achieve desired performance results.

The transition component 102 pivotably connects the anchorless crash cushion apparatus 100 to a traffic divider 112. The transition component 102 may be similar to other hinge components described herein for allowing the anchorless crash cushion apparatus 100 and the traffic divider 112 to be fed through a BTM.

The plurality of crash cushion elements 104 may be positioned inline with each other and may be substantially identical to each other. In some embodiments, several crash cushion elements 104 near the nose assembly 110 may have truncated lower ends, while several crash cushion elements 104 near the transition component 102 may have a relatively fuller volume, as seen in FIG. 1. Each crash cushion element 104 includes a forward end 114, a rearward end 116, left and right stabilizer indentations 118A,B, and left and right BTM indentations 120A,B. The plurality of crash cushion elements 104 may be rigid or semi-rigid containers configured to enclose a liquid, sand, air, or the like. To that end, one or more of the crash cushion elements 104 near the nose assembly 110 may be empty (i.e., full of air) while several of the crash cushion elements 104 aft of the air-filled crash cushion element(s) 104 may be filled with water, sand, or the like.

The left and right stabilizer indentations 118A, B extend longitudinally along sides of the crash cushion element 104 and may include an upper stabilizer indentation and a lower stabilizer indentation (so that there are two stabilizer indentations on each side of the crash cushion element 104). The left and right stabilizer indentations 118A, B receive stabilizing members 106 therein.

The left and right BTM indentations 120A, B extend longitudinally along sides of the crash cushion element 104 and are configured to receive and guide rollers or other components of the BTM. The left and right BTM indentations 120A,B are configured to align with BTM indentations of other crash cushion elements and the nose assembly 110 so that the anchorless crash cushion apparatus 100 can be fed through the BTM.

The plurality of stabilizing members 106 extend longitudinally between the forward end 114 and rearward end 116 of the crash cushion element 104 in the left and right stabilizer indentations 118A,B. The plurality of stabilizing members 106 are configured to stabilize the crash cushion element 104, help keep crash cushion elements aligned and together during and after an impact event, and reduce an amount of debris and debris range due to the impact event.

The plurality of hinge plate assemblies 108 support the crash cushion elements 104 and connect the plurality of crash cushion elements 104 together end-to-end. The hinge plate assemblies 108 are substantially similar and thus the forward-most hinge plate assembly 108 will be described in detail. The hinge plate assembly 108 includes a forward structure 122, a rearward structure 124, and a wedge incline 128.

The forward structure 122 supports a front end of the corresponding crash cushion element 104 and may include a forward hinge component 130 and a complementary incline surface 132 defining an incline recess 134. The forward structure 122 may be positively attached to the forward end 114 of the corresponding crash cushion element 104 via fasteners, interlocking geometry, or the like, or may cradle or bracket the corresponding crash cushion element 104 via a friction fit, approximate fit, or the like.

The forward hinge component 130 pivotably connects the hinge plate assembly 108 to the nose assembly 110 (or to a preceding hinge plate assembly). Importantly, the forward hinge component 130 may be configured to move upward relative to the noise assembly 110 (or a hinge component of a preceding hinge plate assembly) so that the hinge plate assembly 108 can be driven upward during an impact event. The forward hinge component 130 (and other hinge components) may be connected to corresponding hinge components via a pin or similar component.

The incline surface 132 may be configured to engage a wedge incline of the nose assembly 110 (described in more detail below) or a wedge incline of a preceding (i.e., forward adjacent) hinge plate assembly. The incline surface 132 may form an incline recess 134 for accommodating the preceding wedge incline. Other structures such as a cross-beam could be used in place of the incline surface 132.

The rearward structure 124 may include a rearward hinge component 136 and an incline surface 138 defining an incline recess 140. The rearward structure 124 may be positively attached to the rearward end 116 of the corresponding crash cushion element 104 via fasteners, interlocking geometry, or the like, or may cradle or bracket the corresponding crash cushion element 104 via a friction fit, approximate fit, or the like.

The rearward hinge component 136 pivotably connects the hinge plate assembly 108 to a subsequent (i.e., aft adjacent) hinge plate assembly. Importantly, the rearward hinge component 136 may be configured to move downward relative to the corresponding hinge component of the subsequent hinge plate assembly so that the subsequent hinge plate assembly can be driven upward relative to the hinge plate assembly 108 when the hinge plate assembly 108 is driven toward the subsequent hinge plate assembly.

The incline surface 138 may be configured to engage the wedge incline 128 of the corresponding hinge plate assembly 108 as the corresponding crash cushion element 104 collapses. The incline surface 138 may form an incline recess 140 for accommodating the wedge incline 128 of the corresponding hinge plate assembly 108. Other structures such as a cross-beam could be used in place of the incline surface 138.

The wedge incline 128 may include left and right angled sides 142A,B and defines an incline recess 144. The wedge incline 128 extends diagonally upward toward the forward structure 122. The left and right angled sides 142A, B may be shaped to fit in incline recesses of a subsequent hinge plate assembly. As a related matter, the incline recess 144 may be configured to receive a wedge incline of a preceding hinge plate assembly. The wedge incline 128 may be substantially triangular when viewed from the side.

The nose assembly 110 may include a forward component 146 and a rearward component 148. The nose assembly 110 is configured to engage a vehicle and transfer impact forces to the crash cushion elements 104.

The forward component 146 may include a vertical section 150, and a wedge incline 154. The forward component 146 is the forwardmost element of the anchorless crash cushion apparatus 100 and hence is configured to be contacted by a vehicle head-on. The forward component 146 may be made of metal or any other suitable material.

The vertical section 150 may include a lower protrusion 156, an upper protrusion 158, and left and right BTM indentations 160A,B. The lower protrusion 156 and upper protrusion 158 may be configured to vertically bracket the front of the vehicle to ensure the vehicle remains in engagement with the nose assembly 110 and hence the anchorless crash cushion apparatus 100 through the duration of the impact event.

The left and right BTM indentations 160A,B extend longitudinally along sides of the vertical section 150 and are configured to receive and guide rollers or other components of the BTM. The left and right BTM indentations 160A,B are configured to align with BTM indentations of the rearward component 148 and the crash cushion elements 104 so that the anchorless crash cushion apparatus 100 can be fed through the BTM.

The wedge incline 154 may include left and right rails 162A, B. Alternatively, a wedge incline similar to the wedge inclines of the hinge plate assemblies 108 may be used. In one embodiment, a lateral guide 164 may be positioned above the wedge incline 154 to maintain lateral alignment of the forward component 146 and the rearward component 148.

The rearward component 148 may include a rearward hinge component 166, left and right BTM indentations 168A, B, and wedge cross members 170. The rearward component 148 may be configured to facilitate substantially rearward motion of the forward component 146 and effect lifting motion to the crash cushion elements 104.

The rearward hinge component 166 pivotably connects the nose assembly 110 to a first one of the hinge plate assemblies 108. Importantly, the rearward hinge component 166 may be configured to stay grounded relative to the corresponding hinge component of the first one of the hinge plate assemblies 108. Said another way, the corresponding hinge component of the first one of the hinge plate assemblies 108 can be driven upward relative to the nose assembly 110 when the nose assembly 110 is driven toward the hinge plate assemblies 108.

The left and right BTM indentations 168A,B extend longitudinally along sides of the rearward component 148 and are configured to receive and guide rollers or other components of the BTM. The left and right BTM indentations 168A, B are configured to align with BTM indentations of the forward component 146 and the crash cushion elements 104 so that the anchorless crash cushion apparatus 100 can be fed through the BTM.

The wedge cross members 170 extend laterally between sides of the rearward component 148 and may be configured to engage the wedge incline 154 of the forward component 146, as seen in FIG. 5. The wedge cross members 170 are shown as rods diagonally offset from each other at an equivalent angle of the wedge incline 154 of the forward component 146 so that the rearward component 148 remains substantially upright. Alternatively, an inverted, complementary wedge incline may be used.

Turning to FIG. 6, the anchorless crash cushion apparatus 100 arrests a vehicle (not shown) impacting the forward component 146. Specifically, the forward component 146 vertically brackets the vehicle to prevent the vehicle from being catapulted above the anchorless crash cushion apparatus 100. As seen in FIG. 6, the forward component 146 is urged rearward, thereby driving the rearward component 148 up the wedge incline 154 of the forward component 146. The rearward component 148 is in turn driven rearward toward a first one of the crash cushion elements 104. Upward movement of the rearward component 148 does not disconnect the rearward component 148 from the first crash cushion element 104. Rather, the first crash cushion element 104 may be driven upward via the wedge incline 154 of the forward component 146.

The first crash cushion element 104 may collapse longitudinally from impact forces. This drives the forward structure 122 and the wedge incline 128 of the corresponding hinge plate assembly 108 toward the rearward hinge component 136 of the corresponding hinge plate assembly 108. The wedge incline 128 of the corresponding hinge plate assembly 108 thereby drives the rearward structure 124 (and hence a rearward portion of the first crash cushion element 104) upward. Subsequent crash cushion elements may be driven upward in the same manner.

Another important aspect of the invention is a specific construction, sequencing, and positioning of the individual components of the crash cushion 100 to achieve specific performance objectives. This aspect of the invention is best illustrated in FIG. 1, which illustrates a number of energy-absorbing modules identified as A, B, C, D. Each energy-absorbing module comprises one of the crash cushion elements 104, a set of the stabilizing members 106, and one of the hinge plate assemblies 108. In accordance with this aspect of the invention, the energy-absorbing elements A, B, C, D are not all identical, but instead are constructed with different features and positioned or sequenced in particular ways to achieve specific performance objectives.

In one embodiment, the crash cushion 100 includes the nose assembly 110; an energy-absorbing module A of a first type attached to the nose assembly; and at least one energy-absorbing module B of a second type directly or indirectly attached to the energy-absorbing module of the first type.

As discussed above, the nose assembly 110 comprises, among other elements, a wedge incline 154. The energy absorbing module A of the first type comprises a crash cushion element 104 and a hinge plate assembly 108 for supporting the crash cushion element. Importantly, the crash cushion element of the energy absorbing module A is not filled with water or other liquids and only encloses air or other gases. The hinge plate assembly of the energy absorbing module A includes an incline recess 135 that receives the wedge incline 154 of the nose assembly when the nose assembly is driven toward the energy-absorbing module by an impacting vehicle. The interaction between the wedge incline and the incline recess drives the energy-absorbing module upward as the crash cushion element is crushed and compacted. The hinge plate 108 assembly of the energy-absorbing module A also includes a wedge incline 128.

The energy absorbing module B of the second type is substantially the same as the energy absorbing module A except it is filled with liquids. Specifically, the energy absorbing module B comprises a crash cushion element 104 and a hinge plate assembly 108 for supporting the crash cushion element. Importantly, the crash cushion element of the second type is at least partially filled with water or other liquids. The hinge plate assembly includes an incline recess 134 that receives the wedge incline 12 of the energy absorbing module of the first type when the nose assembly is driven toward the energy-absorbing modules by an impacting vehicle. The interaction between the wedge incline and the incline recess drives the energy-absorbing module of the second type upward as the crash cushion elements are crushed and compacted. The hinge plate 108 assembly of the energy absorbing module B also includes a wedge incline 128.

In another embodiment, the crash cushion 100 further comprises at least one energy-absorbing module C of a third type attached to the last energy-absorbing module B of the second type. The energy absorbing module C of the third type is essentially the same as the energy absorbing module B type except its hinge plate assembly has no wedge incline.

In yet another embodiment, the crash cushion further comprises at least one energy-absorbing module D of a fourth type attached to the last energy-absorbing module C of the third type. The energy absorbing module D of the fourth type is essentially the same as the energy absorbing module C of the third type except it has a crash cushion element 104 with a larger volume. Specifically, as shown in FIG. 1, the volumes of the crash cushion elements in the energy absorbing modules D are approximately twice the volumes of the crash cushion elements in the energy absorbing modules A, B, and C.

In one specific embodiment, the crash cushion 100 comprises the nose assembly 110, one energy-absorbing module A of the first type; two energy-absorbing modules B of the second type; three energy-absorbing modules C of the third type; and three energy-absorbing modules D of the fourth type. The crash cushion may also comprise the transition component 112 attached to the last of the energy-absorbing modules of the fourth type for attaching the crash cushion to a traffic divider.

The anchorless crash cushion apparatus 100 provides several advantages. For example, when impacted by a vehicle, the nose assembly 110 elevates its rearward component 148 and the first one of the crash cushion elements 104 while the forward component 146 of the nose assembly 110 remains in contact with the ground/road surface, as seen in FIG. 6. Similarly, the wedge inclines 128 of the crash cushion elements 104 elevate subsequent crash cushion elements 104. This keeps the impacting vehicle from being catapulted or lifted off the ground/road surface. Moreover, by constructing the crash cushion with an unfilled crash cushion element adjacent the nose assembly, filled crash cushion elements after the unfilled one, and higher volume filled crash cushion elements next, an impacting vehicle is slowed and stopped more gradually to reduce the likelihood of injuring passengers of the vehicle.

The anchorless crash cushion apparatus 100 may also be compatible with a BTM. Specifically, the nose assembly 110 and the crash cushion elements 104 are pivotably connected via hinges and include left and right BTM indentations for engaging rollers of the BTM.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A crash cushion for absorbing forces from a vehicle that impacts the crash cushion, the crash cushion comprising:

a nose assembly having a forward vehicle-contacting end and a rearward end and comprising a wedge incline, the wedge incline having an upper surface that slopes downward from the forward end of the nose assembly toward the rearward end of the nose assembly;

an energy-absorbing module of a first type attached to the nose assembly, the energy absorbing module of the first type comprising an unfilled crash cushion element; an incline recess that receives the wedge incline of the nose assembly to lift and drive the energy-absorbing module of the first type upward when the nose assembly is driven toward the energy-absorbing module of the first type by the vehicle; and a wedge incline, the wedge incline having an upper surface that slopes downward from a forward end of the energy-absorbing module toward a rearward end of the energy-absorbing module; and at least one energy-absorbing module of a second type attached to the energy-absorbing module of the first type, the energy absorbing module of the second type comprising a liquid filled crash cushion element; an incline recess that receives the wedge incline of the energy-absorbing module of the first type to lift and drive the energy-absorbing module of the second type upward when the nose assembly is driven toward the energy-absorbing module of the first type by the vehicle; and a wedge incline.

2. The crash cushion as set forth in claim 1, further comprising at least one energy-absorbing module of a third type attached to the energy-absorbing module of the second type, the energy absorbing module of the third type comprising a liquid filled crash cushion element; and an incline recess that receives the wedge incline of the energy-absorbing module of the second type to lift and drive the energy-absorbing module of the third type upward when the nose assembly is driven toward the energy-absorbing module of the first type by the vehicle.

3. The crash cushion as set forth in claim 2, further comprising at least one energy-absorbing module of a fourth type attached to the energy-absorbing module of the third type, the energy absorbing module of the fourth type comprising a liquid filled crash cushion element with a volume greater than a volume of the crash cushion element of the third type.

4. The crash cushion as set forth in claim 1, the nose assembly further comprising:

a forward component with a forward section from which the wedge incline extends; and a rearward component that is spaced from the forward component and configured to be driven upward by the wedge incline when the forward component is driven toward the rearward component by the vehicle.

5. The crash cushion as set forth in claim 1, the energy-absorbing module of the first type further comprising:

a hinge plate assembly comprising:

a forward structure which includes the incline recess;

a rearward structure;

wherein the wedge incline is formed between the forward structure and the rearward structure.

6. The crash cushion of claim 5, wherein the forward structure includes a forward hinge component for pivotally connecting the energy-absorbing module of the first type to the nose assembly; and wherein the rearward structure includes a rearward hinge component for pivotably connecting the energy-absorbing module of the first type to one of the energy-absorbing modules of the second type.

7. The crash cushion as set forth in claim 1, the energy-absorbing module of the second type further comprising:

a hinge plate assembly comprising:

a forward structure which includes the incline recess;

a rearward structure;

wherein the wedge incline is formed between the forward structure and the rearward structure.

8. The crash cushion of claim 7, wherein the forward structure includes a forward hinge component for pivotally connecting the energy-absorbing module of the second type to the energy-absorbing module of the first type or another energy-absorbing module of the second type; and wherein the rearward structure includes a rearward hinge component for pivotably connecting the energy-absorbing module of the second type to one of the energy-absorbing modules of the third type or another energy-absorbing module of the second type.

9. The crash cushion as set forth in claim 2, the energy-absorbing module of the third type further comprising a hinge plate assembly comprising:

a forward structure; and a rearward structure.

10. The crash cushion of claim 9, wherein the forward structure includes a forward hinge component; and wherein the rearward structure includes a rearward hinge component.

11. The crash cushion as set forth in claim 3, the energy-absorbing module of the fourth type further comprising a hinge plate assembly comprising:

a forward structure; and a rearward structure.

12. The crash cushion of claim 11, wherein the forward structure includes a forward hinge component; and wherein the rearward structure includes a rearward hinge component.

13. The crash cushion as set forth in claim 1, the crash cushion comprising two of the energy-absorbing modules of the second type positioned end-to-end.

14. The crash cushion as set forth in claim 2, the crash cushion comprising three of the energy-absorbing modules of the third type positioned end-to-end.

15. The crash cushion as set forth in claim 3, the crash cushion comprising three of the energy-absorbing modules of the fourth type positioned end-to-end.

16. The crash cushion as set forth in claim 3, further comprising a transition component attached to one of the energy-absorbing modules of the fourth type for attaching the crash cushion to a traffic divider.

17. A crash cushion for absorbing forces from a vehicle that impacts the crash cushion, the crash cushion comprising:

a nose assembly comprising:

a forward component comprising:

a forward section; and a wedge incline extending rearwardly from the forward section, the wedge incline having an upper surface that slopes downwardly from the forward section; and a rearward component that is spaced from the forward component and configured to be lifted and driven upward by the wedge incline when the forward component is driven toward the rearward component by the vehicle;

an energy-absorbing module of a first type attached to the nose assembly, the energy absorbing module of the first type comprising:

a hinge plate assembly comprising:

a forward structure having an incline recess that receives the wedge incline of the nose assembly to drive the forward structure upward when the nose assembly is driven toward the first energy-absorbing module by the vehicle;

a rearward structure;

a wedge incline between the forward structure and the rearward structure, a substantially hollow crash cushion element supported by the hinge plate assembly, the crash cushion element having an enclosed chamber having an interior volume of a first amount, the chamber enclosing air but no liquids;

at least two energy-absorbing modules of a second type attached end-to-end to the energy-absorbing module of the first type, each of the energy absorbing modules of the second type comprising:

a hinge plate assembly comprising:

a forward structure having an incline recess that receives the wedge incline of the energy-absorbing module of the first type or the wedge incline of one of the other energy-absorbing modules of the second type to drive the forward structure upward when the crash cushion is impacted by the vehicle;

a rearward structure;

a wedge incline between the forward structure and the rearward structure, a substantially hollow crash cushion element supported by the hinge plate assembly, the crash cushion element having an enclosed chamber having an interior volume of the first amount and enclosing liquid within the chamber;

at least two energy-absorbing modules of a third type attached end-to-end to the energy-absorbing modules of the second type, each of the energy absorbing modules of the third type comprising:

a hinge plate assembly comprising:

a forward structure having an incline recess that receives the wedge incline of one of the energy-absorbing modules of the second type or the wedge incline of one of the other energy-absorbing modules of the third type to drive the forward structure upward when the crash cushion is impacted by the vehicle;

a rearward structure;

a substantially hollow crash cushion element supported by the hinge plate assembly, the crash cushion element having an enclosed chamber having an interior volume of the first amount and enclosing liquid within the chamber;

at least two energy-absorbing modules of a fourth type attached end-to-end to the energy-absorbing modules of the third type, each of the energy absorbing modules of the fourth type comprising:

a hinge plate assembly comprising:

a forward structure having an incline recess that receives the wedge incline of one of the energy-absorbing modules of the third type or the wedge incline of one of the other energy-absorbing modules of the fourth type to drive the forward structure upward when the crash cushion is impacted by the vehicle;

a rearward structure;

a substantially hollow crash cushion element supported by the hinge plate assembly, the crash cushion element having an enclosed chamber having an interior volume of a second amount greater than the first amount, the chamber enclosing liquid.

18. The crash cushion as set forth in claim 17, the crash cushion comprising two of the energy-absorbing modules of the second type positioned end-to-end.

19. The crash cushion as set forth in claim 17, the crash cushion comprising three of the energy-absorbing modules of the third type positioned end-to-end and three of the energy-absorbing modules of the fourth type positioned end-to-end.

20. A crash cushion for absorbing forces from a vehicle that impacts the crash cushion, the crash cushion comprising:

a nose assembly comprising:

a forward component comprising:

a forward section; and a wedge incline extending rearwardly from the forward section, the wedge incline having an upper surface that slopes downwardly from the forward section; and a rearward component that is spaced from the forward component and configured to be lifted and driven upward by the wedge incline when the forward component is driven toward the rearward component by the vehicle;

a first energy-absorbing module attached to the nose assembly, the first energy absorbing module comprising:

a hinge plate assembly comprising:

a forward structure having an incline recess that receives the wedge incline of the nose assembly to drive the forward structure upward when the nose assembly is driven toward the first energy-absorbing module by the vehicle;

a rearward structure;

a wedge incline between the forward structure and the rearward structure, a substantially hollow crash cushion element supported by the hinge plate assembly, the crash cushion element having an enclosed chamber having an interior volume of a first amount, the chamber enclosing air but no liquids;

a second energy-absorbing module attached to the first energy-absorbing module, the second energy absorbing module comprising:

a hinge plate assembly comprising:

a forward structure having an incline recess that receives the wedge incline of the first energy-absorbing module to drive the forward structure upward when the first energy-absorbing module is driven toward the second energy-absorbing module by the vehicle;

a rearward structure;

a wedge incline between the forward structure and the rearward structure, a substantially hollow crash cushion element supported by the hinge plate assembly, the crash cushion element having an enclosed chamber having an interior volume of the first amount and enclosing liquid within the chamber;

a third energy-absorbing module attached to the second energy-absorbing module, the third energy absorbing module comprising:

a hinge plate assembly comprising:

a forward structure having an incline recess that receives the wedge incline of the second energy-absorbing module to drive the forward structure upward when the second energy-absorbing module is driven toward the third energy-absorbing module by the vehicle;

a rearward structure;

a wedge incline between the forward structure and the rearward structure, a substantially hollow crash cushion element supported by the hinge plate assembly, the crash cushion element having an enclosed chamber having an interior volume of the first amount and enclosing liquid within the chamber;

a fourth energy-absorbing module attached to the third energy-absorbing module, the fourth energy absorbing module comprising:

a hinge plate assembly comprising:

a forward structure having an incline recess that receives the wedge incline of the third energy-absorbing module to drive the forward structure upward when the third energy-absorbing module is driven toward the fourth energy-absorbing module by the vehicle;

a rearward structure;

a substantially hollow crash cushion element supported by the hinge plate assembly, the crash cushion element having an enclosed chamber having an interior volume of the first amount and enclosing liquid within the chamber;

a fifth energy-absorbing module attached to the fourth energy-absorbing module, the fifth energy absorbing module comprising:

a hinge plate assembly comprising:

a forward structure;

a rearward structure;

a substantially hollow crash cushion element supported by the hinge plate assembly, the crash cushion element having an enclosed chamber having an interior volume of the first amount and enclosing liquid within the chamber;

a sixth energy-absorbing module attached to the fifth energy-absorbing module, the sixth energy absorbing module comprising:

a hinge plate assembly comprising:

a forward structure;

a rearward structure;

a substantially hollow crash cushion element supported by the hinge plate assembly, the crash cushion element having an enclosed chamber having an interior volume of the first amount and enclosing liquid within the chamber;

a seventh energy-absorbing module attached to the sixth energy-absorbing module, the seventh energy absorbing module comprising:

a hinge plate assembly comprising:

a forward structure;

a rearward structure;

a substantially hollow crash cushion element supported by the hinge plate assembly, the crash cushion element having an enclosed chamber having an interior volume of a second amount that is greater than the first amount, the enclosed chamber enclosing liquid within the chamber.

21. A crash cushion for absorbing forces from a vehicle that impacts the crash cushion, the crash cushion comprising:

a nose assembly having a forward vehicle-contacting end and a rearward end and comprising a wedge incline, the wedge incline having an upper surface that slopes downward from the forward end of the nose assembly toward the rearward end of the nose assembly;

a first energy-absorbing module attached to the nose assembly, the first energy absorbing module comprising a crash cushion element; an incline recess that receives the wedge incline of the nose assembly to lift and drive the energy-absorbing upward when the nose assembly is driven toward the first energy-absorbing module by the vehicle; and a wedge incline; and a second energy-absorbing module attached to the first energy-absorbing module, the second energy absorbing module comprising a crash cushion element; an incline recess that receives the wedge incline of the energy-absorbing module of the first type to lift and drive the second energy-absorbing module upward when the nose assembly is driven toward the first energy-absorbing module type by the vehicle.

* * * * *